US006276323B1

(12) United States Patent
Nakagomi

(10) Patent No.: US 6,276,323 B1
(45) Date of Patent: Aug. 21, 2001

(54) VALVE DRIVE MECHANISM FOR DOHC ENGINE

(75) Inventor: Akira Nakagomi, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/415,978

(22) Filed: Oct. 12, 1999

(30) Foreign Application Priority Data

Oct. 12, 1998 (JP) ..... 10-289427

(51) Int. Cl.[7] ..... F01L 1/26

(52) U.S. Cl. ..... 123/90.27; 123/90.28; 123/193.5; 123/90.22

(58) Field of Search ..... 123/90.27, 193.3, 123/193.5, 90.16, 90.44, 90.23, 90.22, 90.28

(56) References Cited

U.S. PATENT DOCUMENTS

| | | | | |
|---|---|---|---|---|
| 5,099,812 | * | 3/1992 | Yamada | 123/432 |
| 5,148,779 | * | 9/1992 | Okuse et al. | 123/90.28 |
| 5,535,710 | * | 7/1996 | Zoschke et al. | 123/90.23 |
| 5,570,669 | * | 11/1996 | Regueiro | 123/193.5 |
| 5,606,942 | * | 3/1997 | Tsuzuku et al. | 123/90.16 |
| 5,752,479 | * | 5/1998 | Kinoshita et al. | 123/90.44 |

FOREIGN PATENT DOCUMENTS

| | | | | |
|---|---|---|---|---|
| 0 262 250 A1 | | 4/1988 | (EP) . | |
| 0 444 562 A1 | | 9/1991 | (EP) | F01L/1/26 |
| 0 499 601 A1 | | 8/1992 | (EP) . | |
| 0 692 613 A1 | | 1/1996 | (EP) . | |
| 8-128308 | * | 5/1996 | (JP) . | |

* cited by examiner

*Primary Examiner*—Weilun Lo
(74) *Attorney, Agent, or Firm*—McCormick, Paulding & Huber LLP

(57) ABSTRACT

A valve drive mechanism for a DOHC engine which leaves sufficient installation space for a functional part (16) to be located at a central portion of each of cylinder bores (15) even if each cylinder bore is relatively small. When viewed from the top, two intake valves (1) are linearly arranged in parallel to the longitudinal center line of the engine and two exhaust valves (2) are linearly arranged on the opposite side. The center line (8) of an intake camshaft (4) is offset from the mutual center line of the linearly arranged intake valves in a transverse direction of the engine to an outside direction of the associated cylinder bore such that the intake camshaft center line (8) is apart from the longitudinal center line of the engine and the exhaust camshaft center line (8) is offset in the opposite transverse direction from the mutual center line (6) of the linearly arranged exhaust valves (2), with the parallel relationship between the intake and exhaust camshafts being maintained. The distance between the intake camshaft and exhaust camshaft is therefore enlarged as compared with a conventional arrangement.

5 Claims, 3 Drawing Sheets

VALVE DRIVE MECHANISM FOR DOHC ENGINE

BACKGROUND OF THE INVENTION

1. Field of the Invention

The present invention generally relates to multi-valve double-over-head-camshaft engines (referred to as "DOHC engines"), and more particularly to DOHC engines which have relatively large space for installation of a functional part (e.g., injector) along the center line of each of cylinder bores.

2. Description of the Related Art

One of known DOHC engines is a four-valve DOHC engine which has two intake valves and two exhaust valves for each of cylinders and which is equipped with a functional part such as injector or spark plug arranged along the center line of each of the cylinder bores. In this type of DOHC engine, when viewed from the top, intake valves are arranged generally linearly in parallel to the longitudinal center line of the engine, and the exhaust valves are also arranged linearly in parallel to the longitudinal center line of the engine on the opposite side.

In a conventional valve drive mechanism for such a four-valve DOHC engine, when viewed from the top, the center line of a camshaft for the intake valves extends right above the mutual center line of the linearly arranged intake valves, and likewise the center line of the other camshaft for the exhaust valves lies right above the mutual center line of the linearly arranged exhaust valves. Further, the center line of each cam (or cam lobe) lies right above the center of associated valve.

If an engine has relatively small bores, the distance between the intake camshaft and exhaust camshaft is relatively small, and the distance between each two cams (cam lobes) on each camshaft for each cylinder is relatively small. Therefore, the space for a functional part such as injector or spark plug to be installed along the center line of each cylinder bore is also relatively small. Similarly, if the included angle (i.e., an angle between the intake valve and exhaust valve) is small, the spacing between the intake and exhaust camshafts is small so that the installation space for the functional part is small.

An engine having five valves for each cylinder is disclosed in, for example, EP 0 444 562 A1, entitled "Timing System, Particularly For An Internal Combustion Engine With A Number Of Valves Per Cylinder" published on Sep. 4, 1991.

SUMMARY OF THE INVENTION

An object of the present invention is to provide a valve drive mechanism for a DOHC engine which leaves sufficient installation space for a functional part to be arranged along the center line of each of cylinder bores even if each cylinder bore is relatively small and/or the included angle is relatively small.

According to one aspect of the present invention, there is provided a valve drive mechanism for a DOHC engine, the engine having a plurality of intake valves and exhaust valves for each cylinder and a functional part located at a central portion of each cylinder bore, characterized in that when viewed from the top, the center line of the intake camshaft is offset from a mutual center line of the linearly arranged intake valves in a transverse direction of the engine, i.e., to an outward direction of the cylinder bore, such that the intake camshaft center line is apart from the longitudinal center line of the engine and the center line of the exhaust camshaft is offset in the opposite outward direction from a mutual center line of the linearly arranged exhaust valves, with the parallel relationship between the intake and exhaust camshafts being maintained. In short, the distance between the intake camshaft and exhaust camshaft is enlarged as compared with a conventional arrangement. Therefore, larger installation space is ensured for a functional part to be located along the center line of each cylinder.

According to another aspect of the present invention, there is provided a valve drive mechanism for a DOHC engine, the engine having two intake valves and two exhaust valves for each cylinder and a functional part located at a central portion of each cylinder bore, characterized in that when viewed from the top, the center lines of each pair of cams (cam lobes) on each camshaft for each cylinder are offset from the centers of associated valves in the opposite directions in the longitudinal direction of the camshaft. The opposite directions in the longitudinal direction of the camshaft may be defined as follows: to an outside direction of the associated cylinder bore along the associated camshaft.

According to still another aspect of the present invention, there is provided a valve drive mechanism for a DOHC engine which combines the above two aspects of the invention. Specifically, provided is a valve drive mechanism for an engine having two intake valves and two exhaust valves for each cylinder and a functional part arranged along the center line of each cylinder, characterized in that when viewed from the top, the center line of the intake camshaft is offset from the mutual center line of the linearly arranged intake valves to an outside direction of the cylinder bore and the center line of the exhaust camshaft is offset from the mutual center line of the exhaust valves to an (opposite) outside direction of the cylinder bore, with the parallel relationship between the intake and exhaust camshafts being maintained, and the center lines of each pair of cams (cam lobes) on each camshaft for each cylinder are offset from the centers of associated valves to an outside direction of the cylinder bore along the camshaft.

DETAILED DESCRIPTION OF THE INVENTION

Now, embodiments of the present invention will be described in reference to the accompanying drawings.

Figure 1:
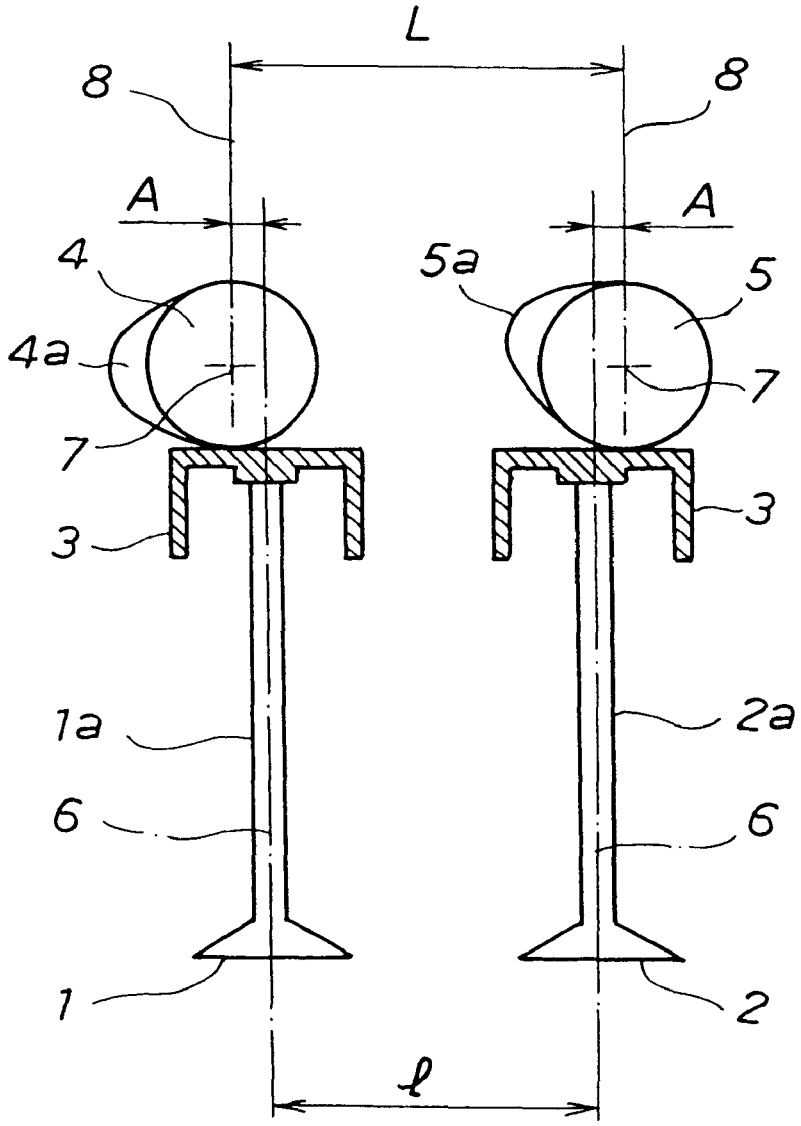
FIG. 1 illustrates a simplified lateral view of a valve drive mechanism in a DOHC engine according to one embodiment of the present invention, which corresponds to the first and third aspects of the present invention.

First Embodiment (first aspect of the invention):

Referring to FIG. 1, illustrated is a DOHC engine having at least one cylinder. The DOHC engine includes two intake valves and two exhaust valves for each cylinder. Reference numeral 1 designates one of the two intake valves, and the other intake valve is located behind the illustrated one. Likewise, reference numeral 2 designates one of the two exhaust valves, and the other exhaust valve is behind the illustrated one. This DOHC engine also has a functional part such as injector or spark plug (not shown) located at a central portion of each cylinder bore. It should be noted that the intake valves may be provided more than two and the exhaust valves may also be provided more than two.

A tappet 3 is arranged at a top of each of stems 1*a* and 2*a* of the intake and exhaust valves 1 and 2. On the tappets 3 and 3, intake camshaft 4 and exhaust camshaft 5 extend in parallel to each other in a direction perpendicular to the drawing sheet. The camshafts 4 and 5 have cam lobes 4*a* and 5*a* which are in contact with the tappets 3 and 3 respectively.

The intake and exhaust camshafts 4 and 5 are offset to an outside direction of the cylinder bore (or outwards in opposite transverse directions) from the center lines 6 and 6 of the associated valves 1 and 2 by amounts of A and A respectively. Specifically, the intake camshaft 4 is shifted to the left in the illustration so that the center line 8 of the intake camshaft 4 is deviated from the center line 6 of the intake valve 1 by the amount of A, and the exhaust camshaft 5 is shifted to the right so that the center line 8 of the exhaust camshaft 5 is offset from the center line 6 of the exhaust valve 2 by the same amount of A. The center line 8 of the camshaft 4/5 is a line extending through the rotation center 7 of the camshaft 4/5 in parallel to the center line 6 of the valve stem 1*a*/2*a*. The parallel relationship between the camshafts 4 and 5 is maintained.

With this arrangement, the distance L between the camshaft center lines 8 and 8 is greater than the distance l between the valve center lines 6 and 6 by the amount of 2·A (i.e., A+A). It should be noted that a conventional arrangement locates the camshafts with the distance l.

Accordingly, even if the engine has relatively small displacement and each of the cylinders has a relatively small bore diameter, i.e., the distance l between the valve center lines 6 and 6 is relatively small, the distance L between the camshaft center lines is still sufficiently large and therefore enough space is left for a functional part (e.g., injector) to be located along the center line of the cylinder bore. Thus, it is even possible to locate a sophisticated fuel injection system along the center line of each of the cylinder bores. This will, for instance, contribute to displacement reduction of direct injection type diesel engines.

Figure 2:
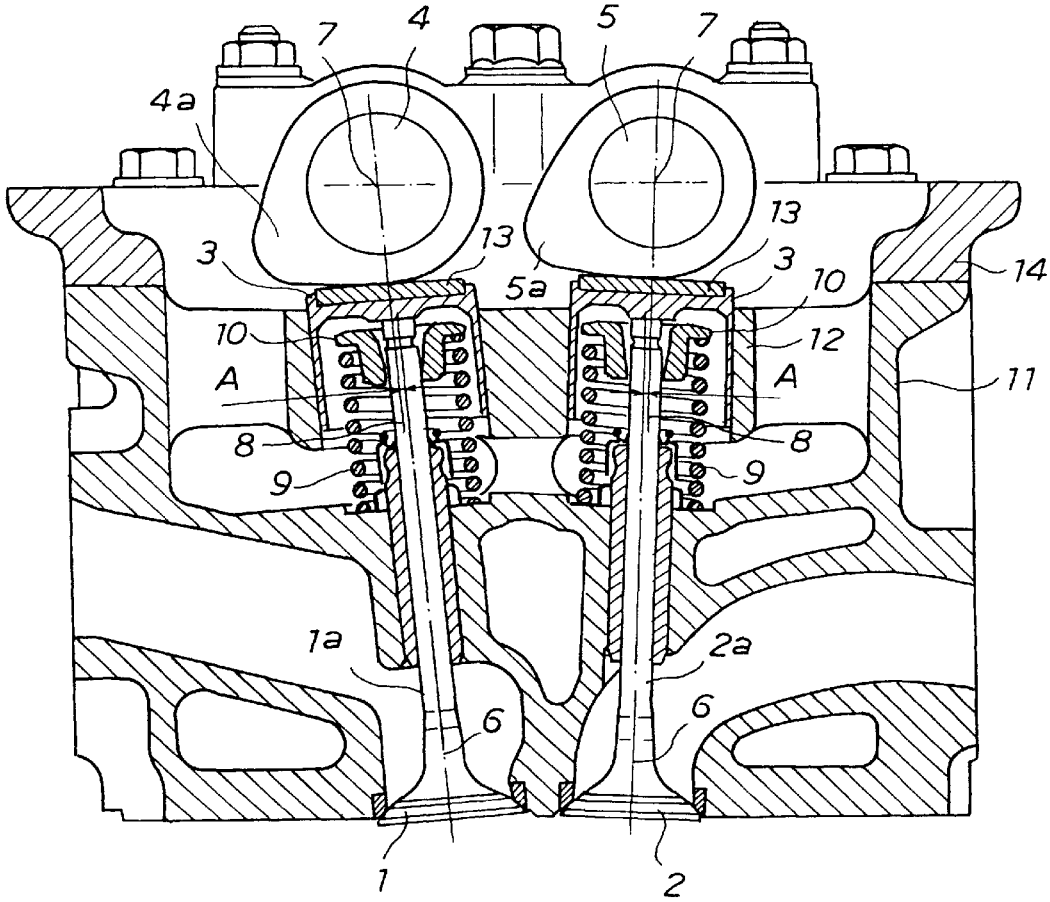
FIG. 2 also illustrates a detailed lateral view of a valve drive mechanism in a DOHC engine according to another embodiment of the present invention, which also correspond to the first and third aspects of the invention.

Second Embodiment (first aspect of the invention):

Referring to FIG. 2, this DOHC engine has a relatively small included angle, i.e., the angle between the intake valve center line 6 and exhaust valve center line 6 is relatively small. Like the first embodiment, the engine includes two or more intake valves and two or more exhaust valves for each cylinder, and only one of the intake valves and only one of the exhaust valves are illustrated. It should be noted that similar reference numerals are used to designate similar parts in FIGS. 1 and 2.

A retainer 10 is provided at an upper end of each of the valve stems 1*a* and 2*a* of the intake and exhaust valves 1 and 2 to support a valve spring 9. A tappet 3 is also provided at the top of each of the valve stems 1*a* and 2*a*. Each of the tappets 3 and 3 is supported in an associated holder 12 of a cylinder head 11 such that it can move in an axial direction of the valve 1/2. A shim 13 is seated in a recess formed in an upper face of each tappet 3.

On the shims 13 and 13, the intake and exhaust camshafts 4 and 5 extend in parallel in a direction perpendicular to the drawing sheet. The camshafts 4 and 5 are rotatably supported by cam carriers 14 mounted on the cylinder head 11. The camshafts 4 and 5 have cam lobes 4*a* and 5*a* respectively and these cam lobes contact the shims 13 and 13.

The intake and exhaust camshafts 4 and 5 are offset to an outside direction of the cylinder bore (or outwards in opposite transverse directions) relative to the intake and exhaust valves 1 and 2. Specifically, the center line 8 of the intake camshaft 4 is offset to the left in the drawing from the center line 6 of the intake valve 1 by an amount of A and the center line 8 of the exhaust camshaft 5 is offset to the right from the center line 6 of the exhaust valve 2 by the same amount of A. The center line 8 of the camshaft 4/5 is a line extending through the rotation center 7 of the camshaft 4/5 in parallel to the valve center line 6. The parallel relationship between the camshafts 4 and 5 is maintained. Conventionally, the center lines of the camshafts coincide with the center lines of the associated valves respectively.

In this invention, accordingly, the distance between the camshaft rotation centers 7 and 7 is greater than the distance between the upper ends of the valve stems 1*a* and 2*a* of the intake and exhaust valves 1 and 2 by the amount of 2·A.

Therefore, even if the engine has a relatively small included angle, the distance between the camshaft centers 7 and 7 is still sufficiently large and adequate installation space is insured for a functional part (e.g., injector; not shown) to be located above the cylinder bore along the center line of the cylinder bore. It should be noted that the same thing can be said to an engine having a relatively small displacement in addition to relatively small included angle.

Figure 3:
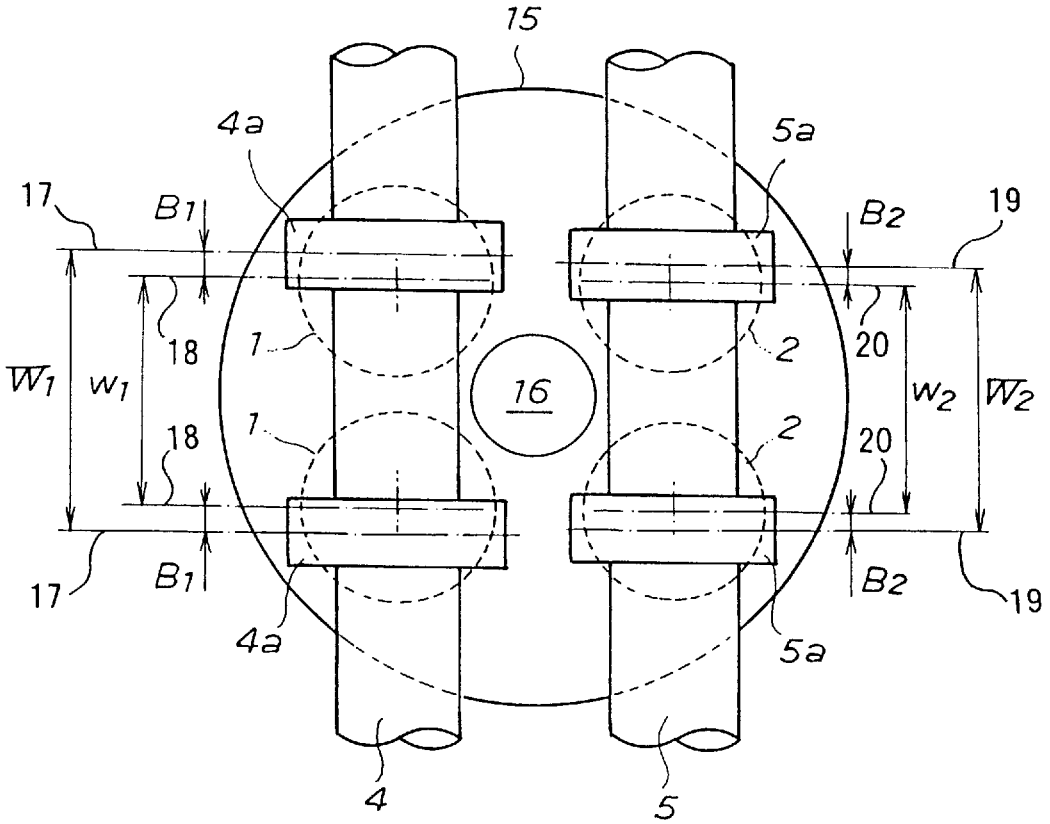
FIG. 3 illustrates a plan view of a valve drive mechanism used in a DOHC engine according to still another embodiment of the present invention, which corresponds to the second and third aspects of the invention.

Third Embodiment (second aspect of the invention):

Referring to FIG. 3, illustrated is a top view of one of a DOHC engine cylinders having two intake valves 1 and 1 and two exhaust valves 2 and 2 for each cylinder. It should be noted that similar reference numerals are used to designate similar parts in FIGS. 1, 2 and 3. A functional part 16 such as injector or spark plug is also illustrated at the center of the cylinder 15. The valves 1, 1, 2 and 2 are opened and closed by lobes 4*a*, 4*a*, 5*a* and 5*a* of the camshafts 4 and 5 respectively. It should also be noted that top views of other cylinders are substantially the same as the illustrated one.

The two cam lobes 4*a* and 4*a* on the intake camshaft 4 are offset in opposite longitudinal directions (upward and downward directions in the drawing) from the centers of the associated intake valves 1 and 1 by the amounts of B1 and B1 respectively. It can also be said that the two intake cam lobes 4*a* and 4*a* are offset in an outside direction of the associated cylinder bore along the intake camshaft 4. In short, the cam lobes 4*a* and 4*a* are further spaced along the intake camshaft 4 as compared with a conventional arrangement. In the conventional arrangement, the center line of the cam lobe coincide with the associated valve center. Likewise, the two cam lobes 5*a* and 5*a* on the exhaust camshaft 5 are offset to an outside direction of the associated cylinder bore along the exhaust camshaft 5 from the centers of the associated exhaust valves 2 and 2 by the amounts of B2 and B2 respectively.

Specifically, the distance W1 between the center lines 17 and 17 of the cam lobes 4*a* and 4*a* of the intake camshaft 4 is greater than the distance w1 between the center lines 18 and 18 of the intake valves 1 and 1 by the amount of 2·B1 (B1 and B1). The center line 18 is a line extending through the intake valve center in parallel to the center line 17 of the cam lobe 4*a*. Similarly, the distance W2 between the center lines 19 and 19 of the cam lobes 5*a* and 5*a* of the exhaust camshaft 5 is greater than the distance w2 between the center lines 20 and 20 of the exhaust valves 2 and 2 by the amount of 2·B2. The center line 20 is a line extending through the exhaust valve center in parallel to the center line 19 of the cam lobe 5*a*.

Therefore, even if the engine has a relatively small displacement (or the cylinder bore 15 is relatively small) and the valve-to-valve distance w1/w2 on each camshaft 4/5 is relatively small, the lobe-to-lobe distance W1/W2 on each camshaft 4/5 is still sufficiently large to accommodate the functional part 16 at (or along) the center line of the cylinder bore 15. Accordingly, it is possible to locate a sophisticated fuel injection system (16) at the center of the cylinder bore 15. This will, for example, contribute to displacement reduction of a direct injection type diesel engine. It should be noted that the amount of offset B1 and that of the offset B2 may be the same.

With this arrangement, another advantage can be expected. Since the cam lobe center line 17/19 is offset from the associated valve center 18/20 (i.e., it is offset from the tappet center line 6 in FIG. 1 or from the shim center line 6 in FIG. 2), rotations of the cam lobes 4*a*/5*a* about the camshaft 4/5 cause the tappets 3 (FIG. 1) or shims 13 (FIG. 2) to rotate about the center lines 6 of the associated valves 1/2. This prevents excessive wear of the cam lobes 4*a* and 5*a* as well as the tappets 3 and shims 13.

Fourth Embodiment (third aspect of the invention):

This embodiment is combination of the above described embodiments. Specifically, in a single engine, the intake and exhaust camshafts 4 and 5 are offset in opposite outward directions of the cylinder bore relative to the intake and exhaust valves 1 and 2 by the amount of As respectively as illustrated in FIG. 1 or 2, and the two intake cam lobes 4*a* and 4*a* are offset in opposite outward directions of the associated cylinder bore along the intake camshaft 4 relative to the intake valves 1 and 1 by the amount of B1s respectively for each cylinder 15 and the two exhaust cam lobes 5*a* and 5*a* are offset in opposite outward directions of the associated cylinder bore along the exhaust camshaft 5 relative to the exhaust valves 2 and 2 by the amount of B2s respectively for each cylinder 15 as illustrated in FIG. 3.

This embodiment is, in effect, illustrated by FIG. 1 or 2 (lateral view) and FIG. 3 (plan view). Combined advantages derived from FIGS. 1 and 3 embodiments or FIGS. 2 and 3 embodiments are obtained in this embodiment. Therefore, much larger space is provided at the cylinder bore center for installation of the functional part 16.

In sum, the present invention provides a valve drive mechanism for a DOHC engine which can leave large space, relative to the cylinder bore, for installation of a functional part along the cylinder bore center line.

It should be noted that the present invention is not limited to the above embodiments. For example, the amount of offset A in FIGS. 1 and 2 may be different from the intake camshaft 4 to the exhaust camshaft 5.

The above described and illustrated valve drive mechanism is disclosed in Japanese Patent Application No. 10-289427 filed on Oct. 12, 1998 in JPO, the subject application claims priority of this Japanese Patent Application, and the entire disclosure thereof is incorporated herein by reference.

What is claimed is:

1. A valve drive mechanism for a DOHC engine, the engine having at least one cylinder, with two intake valves and two exhaust valves being provided for each cylinder, a functional part being located at a central portion of each cylinder bore, comprising:

an intake camshaft having a pair of intake cams for each cylinder, the intake cams of each pair having center lines offset from centers of associated intake valves towards an outside direction of the cylinder bore along the intake camshaft, with a center line of the intake camshaft being offset from a mutual center line of the associated valves towards an outside direction of the cylinder bore; and an exhaust camshaft having a pair of exhaust cams for each cylinder, the exhaust cams of each pair having center lines offset from centers of associated exhaust valves towards an outside direction of the cylinder bore along the exhaust camshaft, with a center line of the exhaust camshaft being offset from a mutual center line of the associated valves towards an outside direction of the cylinder bore, and parallel relationship between the intake and exhaust camshafts being maintained.

2. The valve drive mechanism for a DOHC engine according to claim 1, wherein a total amount of offset made to the intake cams is different from a total amount of offset made to the exhaust cams.

3. The valve drive mechanism for a DOHC engine according to claim 1, wherein a total amount of offset made to the intake cams is equal to a total amount of offset made to the exhaust cams.

4. The valve drive mechanism for a DOHC engine according to claim 1, wherein a stem of each of the intake valves extends in parallel to that of the exhaust valves.

5. The valve drive mechanism for a DOHC engine according to claim 1, wherein a stem of each of the intake valves extends in an angled relationship relative to that of the exhaust valves.

* * * * *